US006206277B1

(12) United States Patent
Correll

(10) Patent No.: US 6,206,277 B1
(45) Date of Patent: Mar. 27, 2001

(54) QUALITY-ENHANCING PIZZA CARTON

(76) Inventor: John D. Correll, 8459 Holly Dr., Canton, MI (US) 48187-4237

( * ) Notice: Subject to any disclaimer, the term of this patent is extended or adjusted under 35 U.S.C. 154(b) by 0 days.

(21) Appl. No.: 09/394,784

(22) Filed: Sep. 13, 1999

Related U.S. Application Data

(63) Continuation-in-part of application No. 09/061,302, filed on Apr. 16, 1998, now Pat. No. 5,961,035, which is a continuation-in-part of application No. 08/731,586, filed on Oct. 16, 1996, now Pat. No. 5,833,130.

(51) Int. Cl.[7] ..... B65D 5/22

(52) U.S. Cl. ..... 229/101; 229/104; 229/110; 229/152; 229/178; 229/906

(58) Field of Search ..... 229/109, 110, 229/101, 104, 152, 154, 178, 902, 906

(56) References Cited

U.S. PATENT DOCUMENTS

| | | | | |
|---|---|---|---|---|
| 3,923,234 | | 12/1975 | Lund, Jr. . | |
| 4,765,534 | | 8/1988 | Zion et al. | 229/109 |
| 5,000,374 | | 3/1991 | Deiger | 229/109 |
| 5,110,039 | | 5/1992 | Philips | 229/110 |
| 5,368,225 | | 11/1994 | Ritter | 229/110 |
| 5,452,845 | * | 9/1995 | Ritter | 229/110 |
| 5,522,537 | | 6/1996 | Barlow | 229/109 |
| 5,535,940 | * | 7/1996 | Olds | 229/110 |
| 5,586,716 | | 12/1996 | Correll | 229/110 |
| 5,702,054 | | 12/1997 | Philips et al. | 229/110 |
| 5,713,509 | | 2/1998 | Correll | 229/109 |
| 5,806,755 | * | 9/1998 | Correll | 229/110 |
| 5,833,130 | * | 11/1998 | Correll | 229/152 |
| 5,881,948 | * | 3/1999 | Correll | 229/101 |
| 6,016,951 | * | 1/2000 | Correll | 229/101 |
| 6,065,669 | * | 5/2000 | Correll | 229/152 |
| 6,092,715 | * | 7/2000 | Correll | 229/110 |

* cited by examiner

*Primary Examiner*—Gary E. Elkins

(57) ABSTRACT

A quality-enhancing pizza carton having an improved fall-back side wall structure with a diagonal wall for verticalizing the fall-back side wall, an improved corner wall structure having a connector panel disposed at an oblique angle to the bottom panel, and a cover anti-shift structure.

36 Claims, 4 Drawing Sheets

78
73
72
74
14
77
62
61
73
70
72
63b
63a
52
54
40
24
26
62
42
20
35
61
53
35
22
54
52
32
37
53

12
63b
61
40
48
63a
42

QUALITY-ENHANCING PIZZA CARTON

CROSS-REFERENCES TO RELATED APPLICATION

This is a continuation-in-part application of my application Ser. No. 09/061,302, entitled "Designer Pizza Box with Enhancements," filed Apr. 16, 1998, now U.S. Pat. No. 5,961,035, which is a continuation-in-part of application Ser. No. 08/731,586, entitled "Multi-function Pizza Carton," filed Oct. 16, 1996, now U.S. Pat. No. 5,833,130.

FIELD OF THE INVENTION

This invention relates to cartons made of foldable material and, in particular, to paperboard boxes for food products such as pizza.

DESCRIPTION OF THE PRIOR ART

Each year millions of hot pizzas are sold for delivery and carry-out. The physical and perceived quality of those pizzas are, in large part, determined by the type of packaging used for transporting them.

Packaging-related problems pertaining to delivery/carry-out pizza include:

1) Pizza-sliding during transport, resulting in deformed pizza and slice separation;
2) Pizza deformation while sliding a cut pizza into the box and deformation of the side walls while cutting a pizza in the box;
3) Loss of heat by conduction from the box bottom into the customer's table top, resulting in "cold pizza;"
4) Condensation development on the customer's table in the area under the box, resulting in the bottom panel of the box absorbing the condensation and becoming soggy and imparting a "cardboard smell" to the pizza;
5) Downward warping of the box cover resulting in the cover contacting the pizza and cheese sticking to the cover;
6) Floppy box structure resulting in drooping of a loaded box and accidental cover opening.

Regarding problem #1, the best solution is to provide a pizza box with at least six sides and preferably eight sides. The prior art discloses various types of pizza boxes with six or more sides. Three of the most commonly used structures are disclosed by Zion et al. U.S. Pat. No. 4,765,534 granted Aug. 23, 1988, Ritter U.S. Pat. No. 5,368,225 granted Nov. 29, 1994, and Philips et al. U.S. Pat. No. 5,702,054 granted Dec. 30, 1997. Other prior art disclosing pertinent structure for boxes with six or more sides include Lund, Jr. U.S. Pat. No. 3,923,234 granted Dec. 2, 1975, Deiger U.S. Pat. No. 5,000,374 granted Mar. 19, 1991, Philips U.S. Pat. No. 5,110,039 granted May 5, 1992, Barlow U.S. Pat. No. 5,522,537 granted Jun. 4, 1996, Correll U.S. Pat. No. 5,586,716 granted Dec. 24, 1996, and Correll U.S. Pat. No. 5,713,509 granted Feb. 3, 1998.

The optimal solution for reducing slice-sliding is an eight-sided box. However, an eight-sided box provides no square corner for packing extra items, such as a sauce cup or a pepperoncini, in with the pizza. Therefore, there remains a problem of how to contain a pizza on eight sides will providing a square corner for packing extra items. The prior art do not solve this problem but my invention does.

Regarding problems #2–5, the prior art do not solve those problems but, again, my invention does.

Regarding problem #6, some prior art provide for a rigid box structure, but most of those boxes require unusual or awkward folding methodology. My invention, on the other hand, provides for a rigid box while allowing for a folding technique similar to that employed for erecting a standard pizza box.

Three previous patents of mine—namely, U.S. Pat. No. 5,806,755 (Product-protecting Pizza Carton) granted Sep. 15, 1998; U.S. Pat. No. 5,833,130 (Multi-function Pizza Carton) granted Nov. 10, 1998; and U.S. Pat. No. 5,881,948 (Expandable Pizza Box and Method of Use) granted Mar. 16, 1999—disclose inventive structure and methods for resolving some of the above problems and, thereby, provide means for enhancing the quality of delivery/carry-out pizza. This patent discloses further inventive structure and, in certain aspects, combines that new structure with the structure of those three prior patents to produce an even higher level of pizza quality enhancement.

So, there has remained a need for resolving the above-described quality-related problems. These problems have not been solved by the prior art but are solved by my invention(s). By solving these problems a pizza company can provide a higher-quality delivery/carry-out pizza.

OBJECT AND ADVANTAGES

Accordingly, the general object of my invention is a carton that provides a means of enhancing the real and perceived quality of delivery/carry-out pizza. More specifically, the object of my invention is a carton that does one or more of the following: (1) reduces slice sliding with eight-sided containment while providing a square corner for packing an extra item, (2) makes it easier to slide a cut pizza into the box, (3) makes it easier to cut a pizza inside the box, (4) reduces heat loss from conduction on a customer's table, (5) reduces the amount of condensation on a table top in the area below a loaded pizza box, (6) reduces the chance of the bottom panel of the box becoming soggy from absorbing condensation off a table top, (7) reduces the chance of the box cover warping downward into a pizza, and (8) provides a means for increasing box rigidity and reducing the chance of accidental cover opening.

The advantage of my invention is enhanced real and perceived quality of delivery/carry-out pizza and resulting increased customer satisfaction and sales.

Further objects and advantages of the invention will become apparent from consideration of the following detailed description, related drawings, and appended claims.

SUMMARY OF THE INVENTION

My invention is a carton that can incorporate one or more of the following features:

1) An improved fall-back side wall structure comprising a side wall, a fall-back corner flap, and a verticalizing structure having a diagonal wall;
2) An improved corner wall structure comprising a diagonal wall and a plurality of hingedly connected connector panels, wherein at least one of the connector panels is disposed at an oblique angle to the bottom panel of the box;
3) One or more thermal-legs projecting downward from a rear wall on a box, the box having a straight front wall, first and second side walls adjacent the front wall, and first and second diagonal walls attached to the rear ends of the first and second side walls;
4) Cover anti-shift means comprising first and second tabs projecting inward from a top edge of a double-panel front wall structure and disposed adjacent the ends of a cover front flap.

Regarding feature #1, my U.S. Pat. No. 5,833,130 (Multi-function Pizza Carton) granted Nov. 10, 1998, discloses a type of fall-back side wall structure in combination with a V-wall structure. However, that patent does not disclose a fall-back side wall structure in combination with a conventional straight front wall structure, as provided by the instant invention. Also, my U.S. Pat. No. 5,881,948 (Expandable Pizza Box and Method of Use) granted Mar. 16, 1999, discloses a type of fall-back side wall structure having a single verticalizing flap attached to a rear end of a fall-back side wall. However, that patent does not disclose a verticalizing structure having a diagonal wall attached to the rear end of a side wall, as provided by the instant invention.

Regarding feature #2, my U.S. Pat. No. 5,806,755 (Product-protecting Pizza Carton) granted Sep. 15, 1998, discloses a corner wall structure having a plurality of hingedly connected connector panels where at least one of the connector panels is disposed at an oblique angle to the bottom panel of the box. However, that patent does not disclose a type of corner wall structure in combination with an end wall having an end edge disposed at an obtuse angle to a bottom edge of the wall, as provided by the instant invention. Further, patent '755 does not disclose a corner wall structure being hingedly connected to the bottom panel of the box, as provided by the instant invention. Finally, patent '755 does not disclose a blank having a second connector panel having a second connector edge disposed at an obtuse angle to a rear end edge of the bottom panel, as provided by the instant invention.

Regarding feature #3, my U.S. Pat. No. 5,833,130 (Multi-function Pizza Carton) and my patent application Ser. No. 09/061,302 (Designer Pizza Box with Enhancements) each disclose a box having a thermal-leg. However, neither discloses a thermal-leg projecting from a rear wall of a box having a straight front wall disposed parallel to the rear wall in combination with first and second side walls disposed adjacent the front wall and first and second diagonal walls attached to rear ends of the side walls, as provided by the instant invention.

Finally, the improved fall-back side wall structure provided herein is combined with various inventions disclosed in my U.S. Pat. Nos. 5,806,755 and 5,833,130 and 5,881,948. The overall result is an improved quality-enhancing pizza carton. Those prior inventions include product anti-slide means (i.e., anti-slide cover flaps), anti-warp flex-lines, thermal-legs, square-corner-forming means, and a pizza-clearing notch in the ancillary panel of a double-panel wall.

My invention typically would be used for packaging relatively flat food products such as pizza; however, it could take other forms for other purposes, as well.

A complete understanding of the invention can be obtained from the detailed description that follows.

LIST OF REFERENCE NUMERALS

Figure 1:
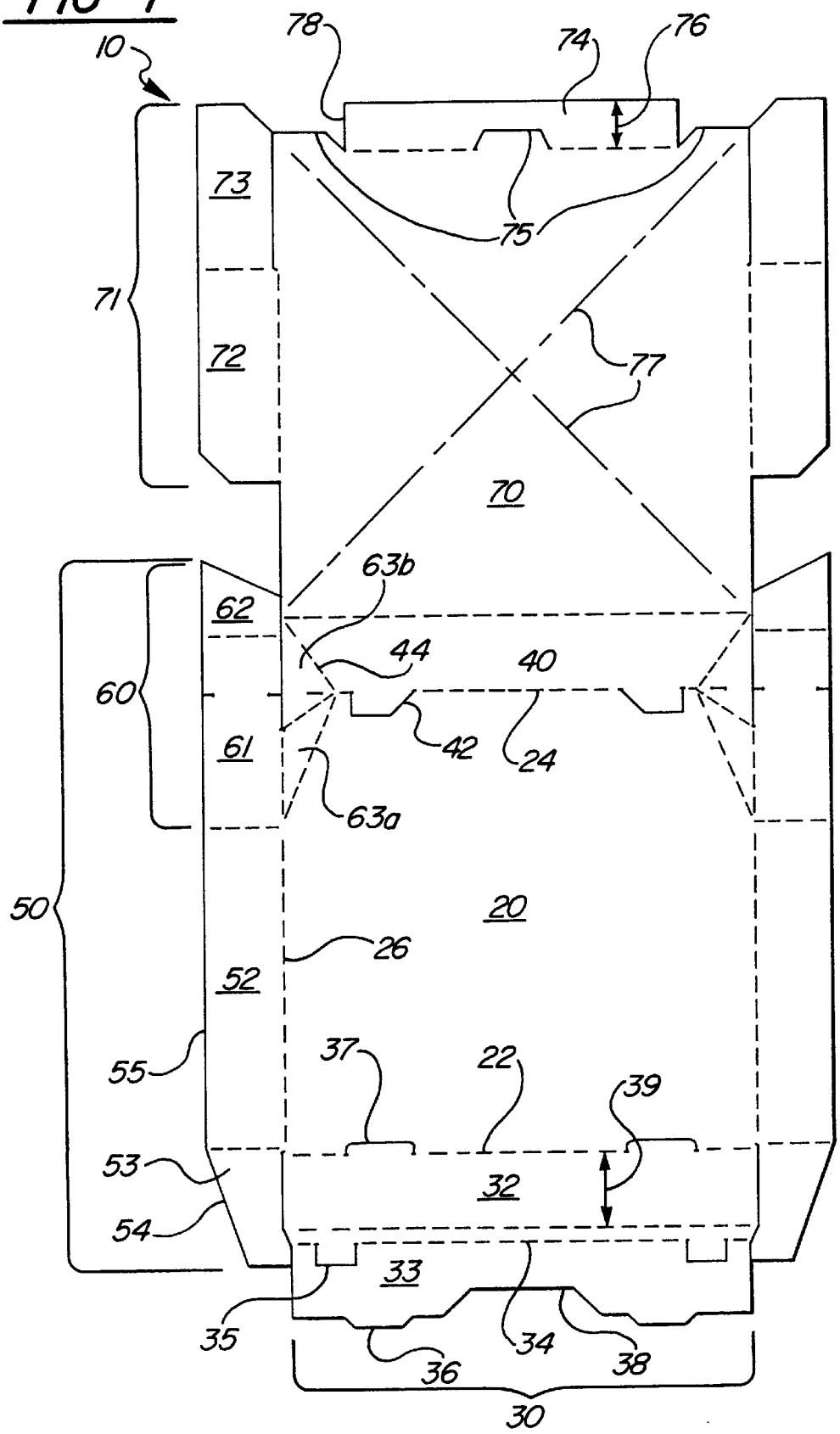
FIG. 1 is a plan view of a blank of the preferred embodiment of the invention.

Between drawings, like reference numerals designate corresponding parts.

| | |
|---|---|
| 10 | blank of the preferred embodiment |
| 12 | fully-erected box of the preferred embodiment |
| 14 | partially-erected box of the preferred embodiment |
| 20 | bottom panel |
| 22 | bottom panel front end edge (also bottom edge of front wall) |
| 24 | bottom panel rear end edge (also bottom edge of rear wall) |
| 26 | bottom panel side edge (also bottom edge of side wall) |
| 30 | double-panel front wall structure |
| 32 | front wall |
| 33 | ancillary panel |
| 34 | pair of narrowly-spaced parallel fold lines |
| 35 | cover anti-shift tab |
| 36 | interlock tab |
| 37 | interlock slot |
| 38 | pizza-clearing notch |
| 39 | height of front wall |
| 40 | rear wall |
| 42 | thermal-leg |
| 44 | end edge of rear wall (also connector edge and fold line) |
| 46 | obtuse angle |
| 48 | oblique angle |
| 50 | fall-back side wall structure |
| 52 | side wall |
| 53 | fall-back corner flap |
| 54 | flap top edge |
| 55 | side wall top edge |
| 60 | verticalizing structure (also corner wall structure) |
| 60a | a first alternate corner wall structure |
| 60b | a second alternate corner wall structure |
| 61 | diagonal wall |
| 62 | free-swinging corner flap |
| 63a | connector panel |
| 63b | connector panel |
| 63c | connector panel |
| 63d | connector panel |
| 63e | connector panel |
| 63f | connector panel |
| 64 | connector edge (also fold line) |
| 65 | connector edge (also fold line) |
| 67 | connector edge (also fold line) |
| 69a | score |
| 69b | score |
| 70 | cover panel |
| 71 | side flap structure |
| 72 | cover side flap |
| 73 | product anti-slide flap |
| 74 | cover front flap |
| 75 | tabs |
| 76 | height of cover front flap |
| 77 | anti-warp flex-lines |
| 78 | end of cover front flap |

DESCRIPTION OF THE PREFERRED EMBODIMENT

Referring now to the drawings, there is illustrated a preferred embodiment of the invention in the format of a one-piece corrugated paperboard blank and, correspondingly, in the formats of fully-erected and partially-erected boxes created from the blank. The intended use for the embodiment is as a food carton or, specifically, a pizza box. However, it will be appreciated, as the description proceeds, that my invention may be realized in different embodiments and may be used in other applications.

Figure 2:
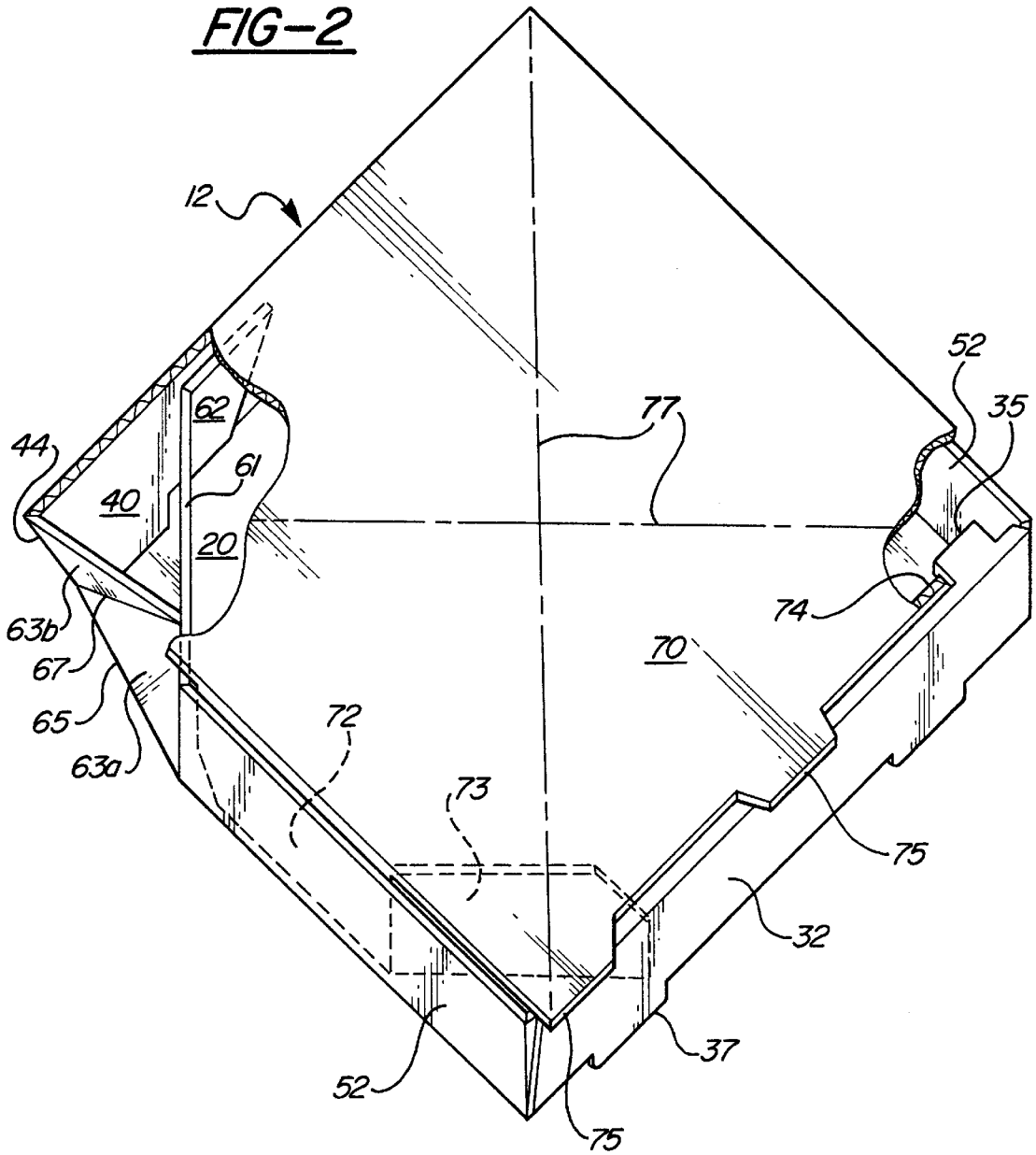
FIG. 2 is a perspective view of a fully-erected carton formed from the blank of FIG. 1.
Figure 3:
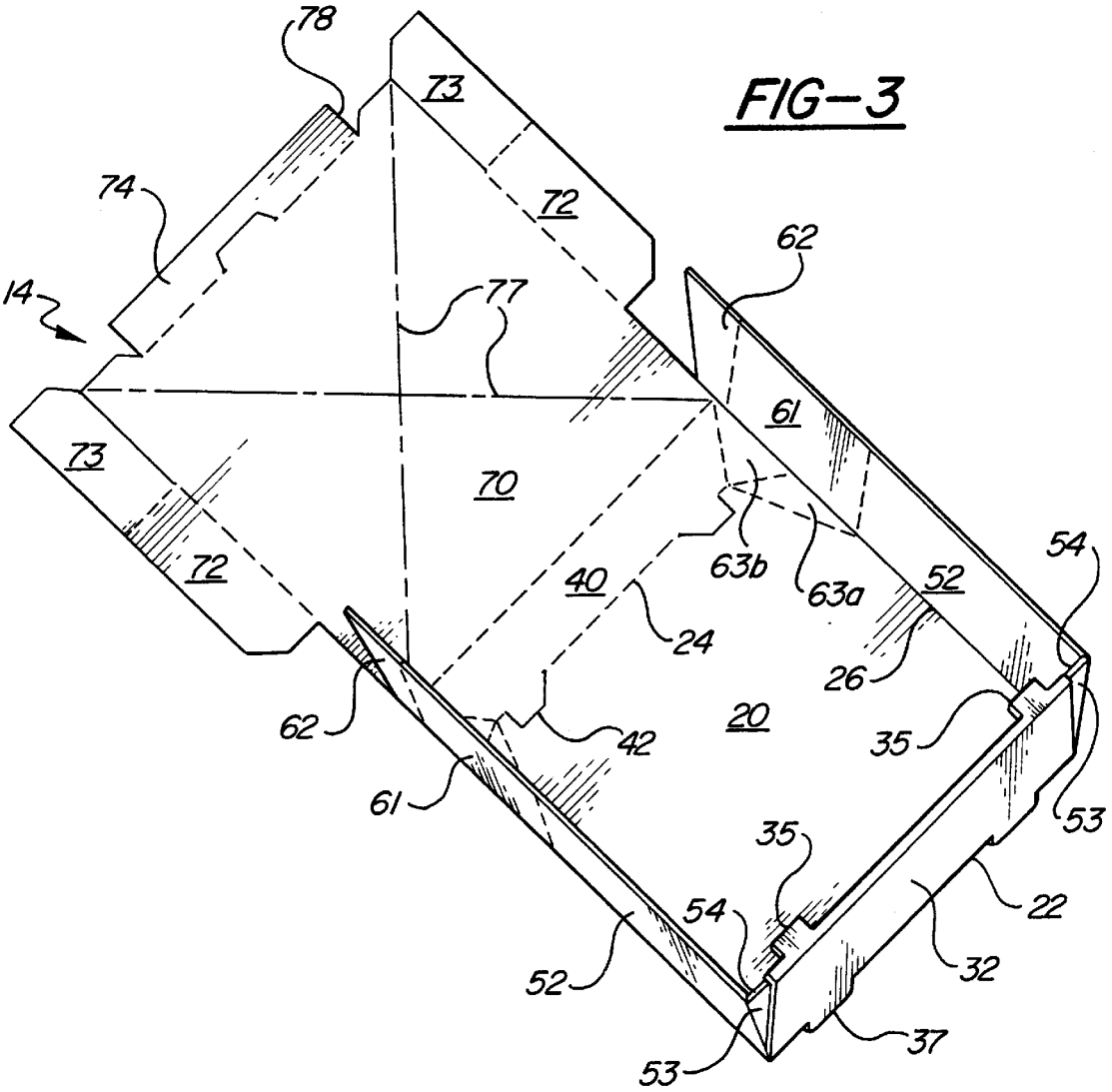
FIG. 3 is a perspective view of a partially-erected carton formed from the blank of FIG. 1.

FIG. 1 shows a blank 10 and FIGS. 2 and 3 show a fully-erected carton 12 and partially-erected carton 14, respectively, created from blank 10. Most referenced components are labeled in FIG. 1; selected components are labeled in other Figures. Corresponding parts between drawings share a same reference numeral. It is noted that the invention is bilaterally symmetrical. Therefore, pairs of opposing like components are to be found, with one item of the pair on each side of the box or blank. For simplicity of labeling, each component pair may be indicated by a numeral on one side of the drawing only. When this occurs, it is to be understood that the discussion also applies to the corresponding component on the other side, even though that component may not be numerically labeled.

Structure of the Invention

Referring now to blank 10 shown in FIG. 1 and also to corresponding boxes 12 and 14 shown in FIGS. 2 and 3, there is a non-rectangular bottom panel 20 which has a front end edge 22, a rear end edge 24, and a pair of opposing side edges 26.

Attached to bottom panel 20 are a double-panel front wall structure 30, a fully-reclinable rear wall 40, and a pair of opposing fall-back side wall structures 50.

Front wall structure 30 has a front wall 32 attached to bottom panel front end edge 22 and an ancillary panel 33 hingedly linked to a top edge of wall 32 by a pair of narrowly-spaced parallel fold lines 34. A suggested distance between the fold lines is at least eight millimeters (5/16-inch), although a wider distance might work better depending on the type of flute in the corrugated board. Projecting from parallel fold lines 34 is a pair of tabs 35 which are a cover anti-shift means. The function of tabs 35 is explained in a subsequent section.

In the box format, ancillary panel 33 is disposed approximately parallel to front wall 32 and is held in place by a pair of interlock tabs 36 that engage with a pair of interlock slots 37. Tabs 35 project inward into the box cavity, as shown in FIGS. 2 and 3. Finally, ancillary panel 33 has a pizza-clearing notch 38 disposed along a bottom edge of the panel. The object of notch 38 is to allow a pizza to fit underneath ancillary panel 33 and, thereby, extend all the way to front wall 32. This allows for a box (and blank) to be made with a slightly shorter front-to-back dimension, thereby providing a small savings of material. Further discussion of the function of a pizza-clearing notch can be found in my U.S. Pat. No. 5,806,755 (Product-protecting Pizza Carton).

Fully-reclinable rear wall 40 is attached to bottom panel rear end edge 24. As used herein, the term "fully-reclinable rear wall" is a rear wall that can recline from a vertical to a horizontal position when the box cover is opened and laid back.

Figure 4:
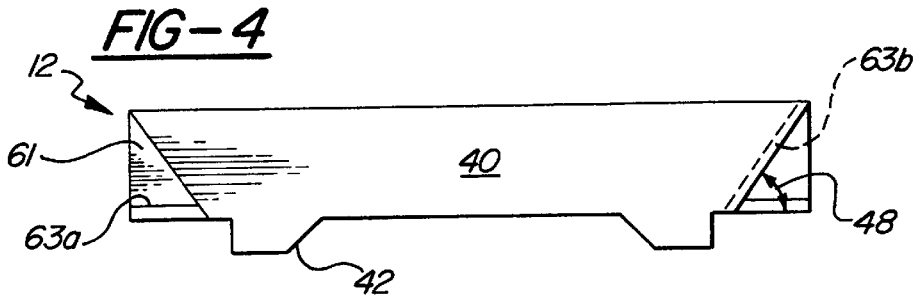
FIG. 4 is a rear elevation view of the fully-erected carton.

A pair of thermal-legs 42, which are a carton elevating means, project downward from the bottom edge of wall 40, as illustrated in FIG. 4. As used herein, the term "thermal-leg" is defined as a projection extending downward below the box bottom of a carton. The main object of thermal-legs is to elevate the bottom panel of a carton above a support surface and, thereby, reduce conductive heat transfer through the box bottom to the support surface. Further discussion of the structure and function of thermal-legs can be found in my U.S. Pat. No. 5,833,130 (Multi-function Pizza Carton) and in my patent application Ser. No. 09/061,302 (Designer Pizza Box with Enhancements), that discussion being included herein by reference thereto.

Figure 5:
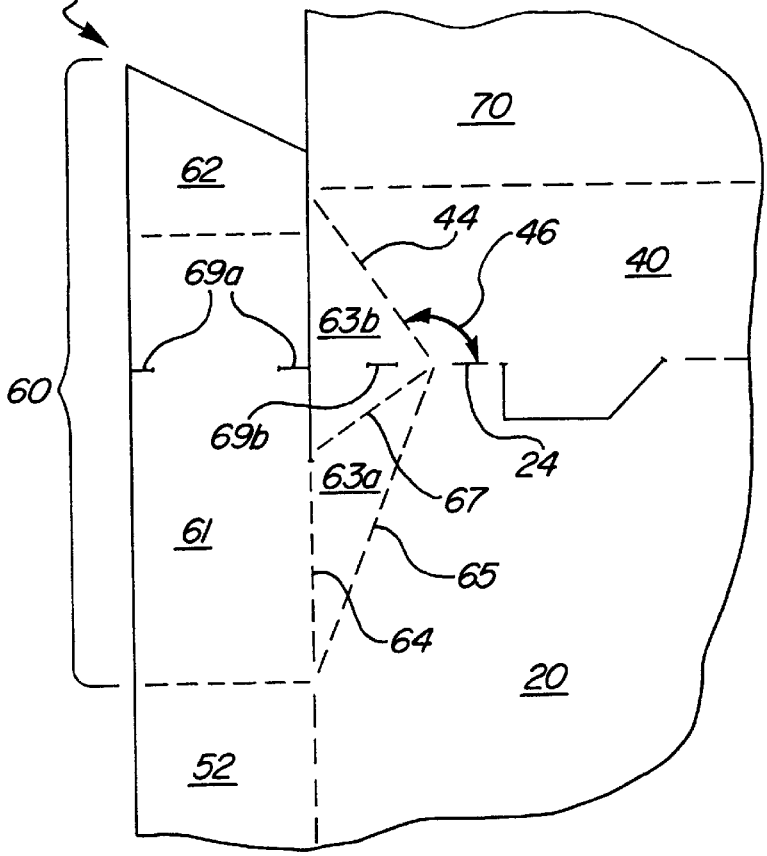
FIG. 5 is a plan view of a section of the blank of FIG. 1 showing the corner wall structure.

As shown in FIG. 5, rear wall 40 has an end edge 44 that is disposed at an obtuse angle 46 to the bottom edge of wall 40, the position of that bottom edge being indicated by numeral 24 in the drawings.

Fall-back side wall structure 50 is an improved variation on a type of fall-back side wall structure disclosed in my U.S. Pat. No. 5,881,948 (Expandable Pizza Box and Method of Use). Structure 50 comprises a side wall 52 attached to bottom panel edge 26, a fall-back corner flap 53 attached to a front end of wall 52, and a verticalizing structure 60 connected to a rear end of wall 52. As used herein, the term "fall-back corner flap" is defined as a flap attached to an end of a side wall and which is of a shape that, when disposed between the panels of an adjacent double-panel wall, can move from a downward position to an upward position and vice versa; and, thereby, can correspondingly allow the side wall to move from a vertical position to a fall-back position and vice versa.

In the box format, fall-back corner flap 53 is disposed between front wall 32 and ancillary panel 33. Flap 53 has a top edge 54 that angles downward from, or is disposed below, a top edge 55 of wall 52. Because of downward-angling edge 54, fall-back corner flap 53 enables side wall 52 to fall back, or angle outward, when the box is open, as shown in FIG. 3. Further discussion on the structure and function of fall-back corner flaps can be found in my U.S. Pat. No. 5,833,130 (Multi-function Pizza Carton) and in my U.S. Pat. No. 5,881,948 (Expandable Pizza Box and Method of Use).

Best viewed in FIG. 5, verticalizing structure 60 comprises a diagonal wall 61 attached to a rear end of side wall 52, a free-swinging corner flap 62 attached to a rear end of diagonal wall 61, and a unitary plurality of hingedly connected connector panels comprising connector panels **63*a* and 63*b*, which link diagonal wall 61 to rear wall 40. Connector panel 63*a* is attached to a bottom edge of diagonal wall 61 at a connector edge (and fold line) 64 and to bottom panel 20 at a connector edge (and fold line) 65. Connector panel 63*b* is attached to panel 63*a* at a connector edge (and fold line) 67 and to rear wall 40 at a connector edge (and fold line) 44. It is noted that connector edge 44 intersects bottom panel rear end edge 24 and is disposed thereto at obtuse angle 46. It is further noted that connector panel 63*b* is triangular-shape. Finally, for proper functioning of the carton, the angle between fold lines 67 and 44 is typically about 90 degrees. A recommended angle between fold lines 64 and 65 is 22** degrees.

Best seen in FIG. 5, verticalizing structure 60 also incorporates a pair of score lines **69*a* in diagonal wall 61 and a score line 69*b* in connector panel 63*b*, which are square-corner-forming means for the carton. Scores lines 69*a*/*b* are substantially aligned with rear edge 24. This structural arrangement enables verticalizing structure 60 to be alternately configured into a square corner by "breaking" wall 61 and panel 63*b* along the axis of score lines 69*a*/*b* during set-up or folding of the box. Operation of this feature is explained in the subsequent section on Operation of the Invention. In place of score lines, short slits or perforations could be used to provide square-corner-forming means. Depiction of square-corner-forming means 69*a*/*b* is shown in the drawing of blank 10 but is not shown in the drawings of cartons 12 and 14. However, even though means 69*a*/*b* cannot be seen in the carton drawings, it is assumed to be there, nonetheless. Further discussion on the structure and function of square-corner-forming means can be found in my U.S. Pat. No. 5,833,130 (Multi-function Pizza Carton). If there should be no need to create a square corner in the carton, square-corner-forming means 69*a*/*b*** might best be omitted.

In the fully-erected box 12, connector panel **63*a* overlies bottom panel 20 and connector panel 63*b* is upright and disposed at an oblique angle 48 to the bottom panel (see FIGS. 2 and 4**).

In the partially-erected box 14, rear wall 40 is disposed in a reclined position, which typically would be coplanar with bottom panel 20. In addition, diagonal wall 61 and connector panels 63*a*, 63*b* may assume one of two positions. The first position, termed the inward position, is similar to that found in the fully-erected box, whereby diagonal wall 61 is disposed at an obtuse angle to side wall 52 and connector panel 63*a* overlies bottom panel 20 and connector panel 63*b* is upright. The second position, termed the outward position, has diagonal wall 61 coplanar to side wall 52 and connector panels 63*a*, 63*b* coplanar to bottom panel 20, as is shown in FIG. 3.

Verticalizing structure 60 also serves as a rear corner wall structure of the carton. Therefore, structure 60 is both a verticalizing structure for fall-back side wall structure 50 and a corner wall structure extending between side wall 52 and rear wall 40.

A cover panel 70 is attached at its rear edge to rear wall 40. It is noted that cover panel 70 has square rear corners. A pair of opposing cover side flap structures 71 are attached to opposing side edges of cover panel 70 and a cover front flap 74 is attached to the front edge. Flap 74 has a pair of opposing flap ends 78. The front edge of cover panel 70 contains forward-projecting tabs 75. In the fully-erected box 12, these tabs overlie the top edge of front wall 32, thereby providing support for cover panel 70. Cover front flap 74 has a height 76 which is less than 80 percent of a height 39 of front wall 32. The shortened height of front flap 74 results in a savings of material. If that's not desired, a full-height cover front flap may be substituted for the shortened-height flap 74.

The left-to-right length of flap 74 is just slightly less than the distance between tabs 35 which project inward from the top edge of front wall structure 30. This arrangement puts flap ends 78 of cover front flap 74 adjacent to tabs 35 (see FIG. 2). This, in turn, prevents sideways shifting of cover panel 70 during handling of a loaded box and, thereby, reduces the chance of accidental cover opening and provides a rigid feel to the carton. As such, tabs 35 are cover anti-shift means.

Cover panel 70 also has a pair of score lines 77, called anti-warp flex-lines, disposed in an X-shape configuration. These score lines act to reduce downward warping of the cover panel of a loaded box, particularly when the cover panel is momentarily bent inwardly along the score lines just prior to closing the cover.

Side flap structure 71 comprises a side flap 72 attached to cover panel 70 and a product anti-slide flap 73 attached to a front end of side flap 72. In the fully-erected box 12, anti-slide flap 73 extends from the side to the front of the box cavity, thereby walling off a front corner space of the box cavity. The object of anti-slide flap 73 is to enable a pizza to be contained on eight sides while maintaining a valuable square corner space for packing an extra item such as a sauce cup along with the pizza. This configuration is illustrated in FIG. 2. Further discussion on the structure and function of anti-slide cover flaps and of anti-warp flex-lines can be found in my U.S. Pat. No. 5,806,755 (Product-protecting Pizza Carton).

Within the context of this invention, a fold line can be created by a number of means such as, for example, by a crease or score in the board, by a series of aligned spaced short slits in the board, and by a combination of aligned spaced short and long slits. In conclusion, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

OPERATION OF THE INVENTION

To erect blank 10 into boxes 12 and 14, the following procedure is used. It is noted that this is similar to the procedure that's commonly used for erecting a standard square pizza box having a double-panel front wall. First, simultaneously fold both front corner flaps 53 to upright position and then fold side walls 52 inward or to upright position. Second, fold front wall 32 to upright position and then fold ancillary panel 33 downward until interlock tabs 36 engage with interlock slots 37. At this point, front wall 32 will be in vertical position, side walls 52 will be in fall-back position, and rear wall 40 will be coplanar with bottom panel 20, resulting in partially-erected box 14 (FIG. 3).

Now you can pursue one of two options: (1) nest the partially-erected box 14 with its outward-angling side walls inside another partially-erected box for use later or (2) finish folding the partially-erected box into fully-erected box 12. To complete the folding of the box, simultaneously push diagonal walls 61 inward, causing them to "flip" into diagonal or inward position. As this is done, rear wall 40 will automatically assume a partially upright position. Pull the cover forward and fold cover side flaps 72 inward so that they slide into the box cavity. During that operation, simultaneously push anti-slide flaps 73 inward so that they also slide into the box cavity. Then push cover front flap 74 downward and close the cover on the box.

During folding of the fully-erected box, two automatic functions occur. First, as the cover is being closed on the box, cover panel 70 pushes diagonal wall 61 to a downward position which, in turn, automatically pulls side wall 52 from fall-back position to vertical position. Second, as rear wall 40 assumes an upright position, thermal-legs 42 move from a coplanar to a perpendicular position with bottom panel 20, thereby providing an elevating means for holding bottom panel 20 above a support surface such as a table.

If desired, one or both of the rear diagonal walls 61 can be converted to a square corner prior to closing the box. To accomplish this, put diagonal wall 61 in the outward position, or coplanar with side wall 52. Then grasp wall 61 on opposing sides of score lines 69*a* and bend the wall so that it "breaks" or folds along the axis of the score lines. Because score lines 69*a* do not extend all the way across wall 61 it will be necessary to apply some pressure to create the "break" or fold. Once the corner is created, pull cover 70 forward and close it on the box. As this is done, connector panel 63*b* will "break" or fold along score line 69*b*, which is substantially aligned with rear edge 24.

To "activate" anti-warp flex-lines 77, fold cover panel 70 along each flex-line by bending the panel about 45 degrees along the flex-line. Typically this is done after a pizza has been loaded into the box and while the cover is being closed onto the box. The result of this action is that it causes cover panel 70 to rise up slightly in the center, forming a "crown" to the cover panel.

CONCLUSION, RAMIFICATIONS, AND SCOPE

I have disclosed a quality-enhancing pizza carton having:

(a) an improved fall-back side wall structure comprising a side wall, a fall-back corner flap, and a verticalizing structure having a diagonal wall;

(b) an improved corner wall structure comprising a diagonal wall and a unitary plurality of hingedly connected connector panels, wherein at least one of the connector panels is disposed at an oblique angle to the bottom panel of the box;

(c) a thermal-leg projecting downward from a rear wall of the box, the box having a straight front wall, first and second side walls adjacent the front wall, and first and second diagonal walls attached to the rear ends of the first and second side walls;

(d) cover anti-shift means comprising first and second tabs projecting inward from a top edge of a double-panel front wall structure and disposed adjacent the ends of a cover front flap.

The illustrated number, size, shape, type, and placement of components represent the preferred embodiment; however, many other combinations and configurations are possible within the scope of the invention. Following are of some examples of alternate configurations or modifications upon the invention.

Figure 6:
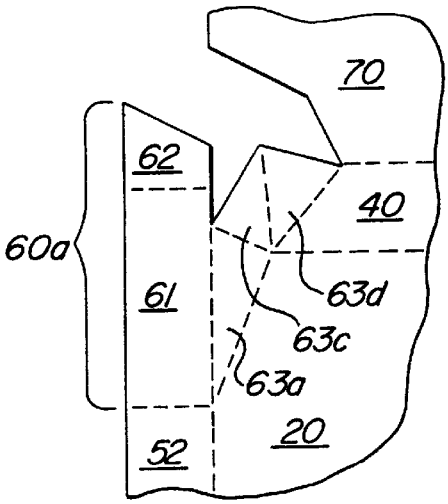
FIG. 6 is a plan view of a section of a blank having a first alternate corner wall structure.
Figure 7:
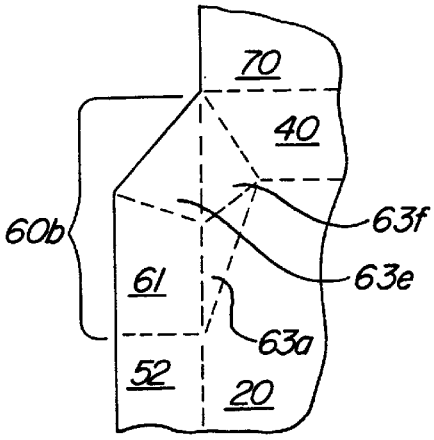
FIG. 7 is a plan view of a section of a blank having a second alternate corner wall structure.

A first alternate corner wall structure 60*a*, which is shown in FIG. 6, could be used in place of structure 60. A second alternate corner wall structure 60*b*, which is shown in FIG. 7, also could be used in place of structure 60. Both are shown in the format of a box blank. In structure 60*b*, connector panel 63*a* could be omitted, if desired, thereby creating a third alternate configuration of corner wall structure.

Also, a modification of the structure of the invention could be created by substituting a shortened-height ancillary panel in place of ancillary panel 33. If this were done, the shortened-height ancillary panel would not interlock into a parallel position with front wall 32 but, instead, be disposed perpendicular to the front wall in the fully-erected box.

The foregoing discussion has pertained mainly to packaging relatively flat food products such as pizza. However, it should be realized that my invention could be used for other purposes, as well. In conclusion, it is understood that the invention is not to be limited to the disclosed embodiment but, on the contrary, is intended to cover various modifications and equivalent arrangements included within the spirit and scope of the appended claims.

I claim:

1. A fully-erected carton having a fall-back side wall structure, said carton being of foldable material and comprising:

a non-rectangular bottom panel, a fully-reclinable rear wall hingedly attached to said bottom panel, a cover panel hingedly attached to a top edge of said rear wall, a substantially straight front wall structure disposed approximately parallel to said rear wall and comprising a front wall attached to said bottom panel and an ancillary panel hingedly linked to a top edge of said front wall and disposed substantially parallel to said front wall, at least one fall-back side wall structure disposed adjacent said front wall structure and comprising:

(a) a side wall hingedly attached to said bottom panel, (b) a fall-back corner flap attached to a front end of said side wall and at least partially disposed between said front wall and said ancillary panel, (c) a verticalizing structure comprising a diagonal wall hingedly attached to a rear end of said side wall and disposed at an obtuse angle to said side wall, whereby when said cover is closed on said carton said diagonal wall holds said side wall in a substantially vertical position.

2. The carton of claim 1 wherein:

said verticalizing structure further comprises a free-swinging corner flap attached to a rear end of said diagonal wall.

3. The carton of claim 1 wherein:

said verticalizing structure further comprises a connector panel hingedly attached to said diagonal wall.

4. The carton of claim 3 wherein:

said verticalizing structure further comprises a corner flap.

5. The carton of claim 3 wherein:

said connector panel is hingedly attached to said bottom panel and to a bottom edge of said diagonal wall.

6. The carton of claim 3 wherein:

said verticalizing structure further comprises another connector panel hingedly attached to said connector panel.

7. The carton of claim 6 wherein:

said another connector panel is hingedly linked to said rear wall.

8. The carton of claim 7 wherein:

the only connector panels in said verticalizing structure are said connector panel and said another connector panel.

9. The carton of claim 7 wherein:

said another connector panel is disposed at an oblique angle to said bottom panel.

10. The carton of claim 1 further comprising:

a product anti-slide structure.

11. The carton of claim 10 wherein:

said product anti-slide structure comprises a flap structure hingedly attached to said cover panel, wherein at least a portion of said flap structure is disposed diagonally between the front wall structure and said side wall.

12. The carton of claim 1 wherein:

said cover panel contains at least one anti-warp flex-line.

13. The carton of claim 1 wherein:

said front wall structure further comprises a cover anti-shift structure.

14. The carton of claim 13 wherein:

said cover anti-shift structure comprises first and second tabs projecting inward from a top edge of said front wall structure, said first and second tabs being disposed adjacent to first and second ends, respectively, of a cover front flap hingedly attached to a front edge of said cover panel.

15. The carton of claim 1 wherein:

said carton further comprises a thermal-leg.

16. The carton of claim 1 wherein:

said ancillary panel has a pizza-clearing notch disposed along a bottom edge thereof.

17. A partially-erected food carton having a fall-back side wall structure, said carton being of foldable material and comprising:

a non-rectangular bottom panel having approximately parallel front and rear edges and opposing first and second side edges adjacent said front edge, a fully-reclinable rear wall hingedly attached to said rear edge, a cover panel hingedly attached to a top edge of said rear wall, an upright front wall structure comprising a front wall attached to said front edge and an ancillary panel hingedly linked to a top edge of said front wall and disposed substantially parallel to said front wall, opposing first and second fall-back side wall structures each comprising:

(a) a side wall hingedly attached to one of said first and second side edges and disposed in a fall-back position and being movable therefrom to a vertical position, (b) a fall-back corner flap hingedly attached to a front end of said side wall and at least partially disposed between said front wall and said ancillary panel, (c) a verticalizing structure comprising a diagonal wall hingedly attached to a rear end of said side wall and a connector panel hingedly attached to said diagonal wall;

whereby, compared to a box having stationary vertically-disposed side walls, said partially-erected food carton with said side walls disposed in said fall-back position provides opportunity for extra operational convenience such as easier loading of a food product into the carton, easier cutting of a food product inside the carton, or cutting of a food product inside the carton without running over or bending a side wall of the carton.

18. The carton of claim 17 wherein:

each said diagonal wall is disposed substantially coplanar to one of said side walls and each said connector panel is disposed substantially coplanar to said bottom panel.

19. The carton of claim 17 wherein:

said verticalizing structure further comprises another connector panel hingedly attached to said connector panel and to said rear wall, wherein the only connector panels in said verticalizing structure are said connector panel and said another connector panel.

20. A blank for a carton having a fall-back side wall structure, said blank being of foldable material cut and scored to define:

a non-rectangular bottom panel having approximately parallel front and rear edges and opposing first and second side edges adjacent said front edge, a fully-reclinable rear wall hingedly attached to said rear edge, a cover panel hingedly attached to a top edge of said rear wall, a front wall structure comprising a front wall hingedly attached to said front edge and an ancillary panel hingedly linked to a top edge of said front wall, opposing first and second fall-back side wall structures hingedly attached to said first and second side edges, respectively, each of the fall-back side wall structures comprising:

(a) a side wall hingedly attached to one of said first and second side edges, (b) a fall-back corner flap hingedly attached to a front end of said side wall, (c) a verticalizing structure comprising a diagonal wall hingedly attached to a rear end of said side wall and a connector panel hingedly attached to said diagonal wall;

whereby after the blank has been erected into a closed box said diagonal wall holds said side wall in a substantially vertical position.

21. The blank of claim 20 wherein:

said verticalizing structure further comprises another connector panel hingedly attached to said connector panel and to said rear wall, wherein the only connector panels in said verticalizing structure are said connector panel and said another connector panel.

22. A carton having a corner wall structure, said carton comprising a bottom panel, a side wall, a diagonal wall attached to said side wall, an end wall having a bottom edge and an end edge, and a unitary plurality of hingedly connected connector panels attached to said diagonal wall and to the end edge of said end wall, wherein:

the end edge of said end wall is disposed at an obtuse angle to said bottom edge.

23. The carton of claim 22 wherein:

said unitary plurality of hingedly connected connector panels consists of two connector panels.

24. A carton having a corner wall structure, said carton comprising a bottom panel, a side wall, a diagonal wall attached to said side wall, an end wall, and a unitary plurality of hingedly connected connector panels attached to said diagonal wall and to said end wall and including a first connector panel hingedly attached to said diagonal wall and to said bottom panel, wherein:

said unitary plurality of hingedly connected connector panels further includes a second connector panel disposed at an oblique angle to said bottom panel.

25. The carton of claim 24 wherein:

said unitary plurality of hingedly connected connector panels consists of said first and second connector panels.

26. A blank for a carton having a corner wall structure, said blank being of foldable material cut and scored to define:

a non-rectangular bottom panel having non-adjacent first and second bottom panel edges, a first wall hingedly attached to said first bottom panel edge, a corner wall structure comprising:

(a) a diagonal wall hingedly attached to an end of said first wall, (b) a unitary plurality of hingedly connected connector panels comprising:

(i) a first connector panel hingedly attached to said diagonal wall, (ii) a second connector panel hingedly attached to said first connector panel at a first connector edge and to another panel of said blank at a second connector edge intersecting said second bottom panel edge, wherein said second connector edge is disposed at an obtuse angle to said second bottom panel edge, whereby after said blank has been erected into a box said second connector panel is disposed at an oblique angle to said bottom panel.

27. The blank of claim 26 wherein:

said second connector panel is substantially triangular-shape.

28. The blank of claim 26 wherein:

said diagonal wall contains at least one square-corner-forming score line substantially aligned with said second bottom panel edge.

29. The blank of claim 26 wherein:

said first connector panel is hingedly attached to a bottom edge of said diagonal wall.

30. The blank of claim 29 wherein:

said corner wall structure further comprises a free-swinging corner flap hingedly attached to an end of said diagonal wall.

31. The blank of claim 26 wherein:

said another panel of said blank is a second wall hingedly attached to said second bottom panel edge, said unitary plurality of hingedly connected connector panels consists of said first and second connector panels.

32. The blank of claim 31 further comprising:

a cover panel hingedly attached to a top edge of said second wall, said cover panel having substantially square rear corners.

33. A carton having a cover anti-shift structure, said carton comprising a rear wall, a double-panel front wall structure opposing said rear wall, a cover panel, and a cover front flap hingedly attached to said cover panel and disposed approximately parallel to said double-panel front wall structure, wherein:

said cover anti-shift structure comprises first and second tabs projecting inward from a top edge of the front wall structure and disposed adjacent to first and second ends, respectively, of said cover front flap, whereby said cover panel is rendered more stationary than a cover panel of some cartons lacking said first and second tabs.

34. The carton of claim 33 wherein:

said cover front flap and said double-panel front wall structure each have a predetermined height, the predetermined height of said cover front flap being less than 80 percent of the predetermined height of said double-panel front wall structure.

35. A carton having a cover anti-shift structure, said carton comprising a double-panel wall structure, another wall, a cover panel hingedly attached to said another wall, and a cover flap hingedly attached to said cover panel and disposed approximately parallel to said double-panel wall structure, wherein:

said cover anti-shift structure comprises a tab projecting inward from a top edge of said double-panel wall structure and disposed adjacent to an end of said cover flap.

36. The carton of claim 35 wherein:

said cover anti-shift structure further comprises another tab.

* * * * *